US008879972B2

(12) United States Patent
Kawamoto et al.

(10) Patent No.: US 8,879,972 B2
(45) Date of Patent: Nov. 4, 2014

(54) FUSER AND IMAGE-FORMING APPARATUS

(75) Inventors: Hisashi Kawamoto, Atsugi (JP); Kenji Maeda, Isehara (JP); Kenji Taguchi, Zama (JP); Yukari Isoe, Ebina (JP); Toshiki Yokoyama, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 180 days.

(21) Appl. No.: 13/553,111

(22) Filed: Jul. 19, 2012

(65) Prior Publication Data

US 2013/0022381 A1 Jan. 24, 2013

(30) Foreign Application Priority Data

Jul. 21, 2011 (JP) ..... 2011-159836

(51) Int. Cl.
*G03G 15/20* (2006.01)

(52) U.S. Cl.
CPC ..... *G03G 15/2053* (2013.01); *G03G 15/2042* (2013.01)
USPC ..... 399/328

(58) Field of Classification Search
CPC ..... G03G 15/2017; G03G 15/2064; G03G 15/2082
USPC ..... 399/328, 334
See application file for complete search history.

(56) References Cited

U.S. PATENT DOCUMENTS

| | | | |
|---|---|---|---|
| 5,991,569 | A | 11/1999 | Sugihara et al. |
| 6,070,037 | A | 5/2000 | Sugihara et al. |
| 6,072,967 | A | 6/2000 | Sugihara et al. |
| 6,104,900 | A | 8/2000 | Ishikawa et al. |
| 6,122,469 | A | 9/2000 | Miura et al. |
| 6,336,020 | B1 | 1/2002 | Ishikawa et al. |
| 7,842,443 | B2 | 11/2010 | Yamazaki et al. |
| 2008/0124152 | A1 | 5/2008 | Nishikawa et al. |
| 2012/0177418 | A1 | 7/2012 | Hashiyada et al. |

FOREIGN PATENT DOCUMENTS

| | | | |
|---|---|---|---|
| JP | 11024473 A | * | 1/1999 |
| JP | 2000-221835 | | 8/2000 |
| JP | 2008-33240 | | 2/2008 |

OTHER PUBLICATIONS

Echigo et al. (JP 11-024473 A), Jan. 1999, JPO Computer Translation.*
U.S. Appl. No. 13/414,164, filed Mar. 7, 2012, Matsusaka, et al.

* cited by examiner

*Primary Examiner* — David Gray
*Assistant Examiner* — Erika J Villaluna
(74) *Attorney, Agent, or Firm* — Oblon, Spivak, McClelland, Maier & Neustadt, L.L.P.

(57) ABSTRACT

A fuser includes a cylindrical heating rotating body including a heat generator and a pressure rotating body including a circumferential face which has contact with the heating rotating body to form a nip portion for fusing, wherein a disk-like outside plate, which is exposed outside, is provided in one end or both ends of the heating rotating body in a rotation axis direction, a disk-like inside plate is provided in an inner circumferential face of the heating rotating body on an inside of the outside plate to have an interval relative to the outside plate, a center vent is provided near a center of the outside plate, an outer edge vent is provided in an outer edge or the neighborhood thereof of the outside plate, and a flow path, which connects the center vent and the outer edge vent, is provided between the outside vent and the inside vent.

11 Claims, 9 Drawing Sheets

FUSER AND IMAGE-FORMING APPARATUS

PRIORITY CLAIM

The present application is based on and claims priority from Japanese Patent Application No. 2011-159836, filed on Jul. 21, 2011, the disclosure of which is hereby incorporated by reference in its entirety.

BACKGROUND

1. Field of the Invention

The present invention relates to a fuser for use in an image-forming apparatus which performs an electrophotographic type image-forming process such as a printer, facsimile, copier, or complex machine including these functions and an image-forming apparatus using the fuser. In particular, the present invention relates to a fuser which fuses a toner image on a surface of a recording medium by means of heat and pressure and an image-forming apparatus using the same.

2. Description of the Related Art

An electrophotographic type apparatus, for example, a laser printer includes a rotatable photoreceptor drum. In this laser printer, after a photoreceptor layer of the photoreceptor drum is uniformly charged, an electrostatic latent image is formed by the exposure with a laser beam from a laser scanning unit, the electrostatic latent image is developed by toners as a toner image, the toner image is transferred on a recording medium (a material to be recorded) such as a transfer sheet, and the recording medium passes through the fuser such that the toner image is fused on the recording medium.

In a conventional fuser, a heat generator such as a halogen lamp is arranged in a hollow portion of a hollow cylinder body made of aluminum, for example, along the rotation axis of the hollow cylinder, and a fusing roller is heated from the inside thereof by the radiation heat of the heat generator. A pressure roller which presses the fusing roller is provided parallel to the fusing roller. A recording medium passes through the nip portion formed between the pressure roller and the fusing roller, so that unfused toners adhered on the surface of the recording medium are melted by the heat of the fusing roller, and are fused on the surface of the recording medium by the pressure.

In such a roller heating type fuser, a temperature in a sheet non-passing portion of the fusing roller, namely, the end portions of the fusing roller is increased due to long period of continuous fusing of small size recording media. If a standard size or a large size recording medium is fused in the temperature-increased condition in the end portions, hot offset may occur in a range corresponding to a small size sheet non-passing portion.

In order to prevent such hot offset, the power distribution of the heat generator is controlled such that the temperature in the end portions of the fusing roller becomes a predetermined temperature or below. It is also necessary to maintain the central portion of the fusing roller to be a required temperature or above. Therefore, the frequency of the power distribution control of the heat generator is increased, causing flicker.

As a technique which controls variations in temperature in the axial direction of the fuser, Japanese Patent Application Publication No. 2000-221835 discloses a technique which lowers the amount of heat generation in a high temperature area and increases the amount of heat generation at a low temperature area during the continuous passing of small size recording materials by using a heat generator having temperature dependency. This technique is for a belt nip method in which a heat generator is arranged in an endless film, not for a fusing roller. A nip portion is formed between the film and a pressure unit by pressing the heat generators via the film with the pressure unit from the outside of the film. Therefore, the heat conductivity of the heating member using the film is largely restricted. For this reason, such a technique can not be simply applied to a mainstream roller heating method.

Japanese Patent Application Publication No. 2008-033240 discloses a carbon lamp as a heat generator which emits infrared light, and a technique which provides a reflection member for locally limiting a heating range by the carbon lamp in a nip portion. However, the surface of the reflection member is deteriorated by the use for a long period of time, so that the light distribution is changed. For this reason, a desired temperature distribution can not be obtained, and the control of the flicker may not be maintained for a long period of time.

SUMMARY

It is, therefore, an object of the present invention to provide a fuser having a cylindrical heating rotating body in which variations in temperature distribution in the axial direction of the rotating body are controlled, and an image-forming apparatus using the fuser.

In order to achieve the above object, one embodiment of the present invention provides a fuser that includes a cylindrical heating rotating body including a heat generator, and a pressure rotating body including a circumferential face which has contact with the heating rotating body to form a nip portion for fusing, wherein a disk-like outside plate, which is exposed outside, is provided in one end or both ends of the heating rotating body in a rotation axis direction, a disk-like inside plate is provided in an inner circumferential face of the heating rotating body on an inside of the outside plate to have an interval relative to the outside plate, a center vent is provided near a center of the outside plate, an outer edge vent is provided in an outer edge or the neighborhood thereof of the outside plate, and a flow path, which connects the center vent and the outer edge vent, is provided between the outside vent and the inside vent.

BRIEF DESCRIPTION OF THE DRAWINGS

The accompanying drawings are included to provide further understanding of the invention, and are incorporated in and constitute a part of this specification. The drawings illustrate embodiments of the invention and, together with the specification, serve to explain the principle of the invention.

FIG. 9A is a plan view illustrating a slidable division plate, FIG. 9B is a perspective view illustrating a heat deformation member, and FIG. 9C is a plan view illustrating a fastening division plate.

DESCRIPTION OF THE PREFERRED EMBODIMENT

Hereinafter, a fuser and an image-forming apparatus according to an embodiment of the present invention will be described with reference to the drawings.

Figure 1A:
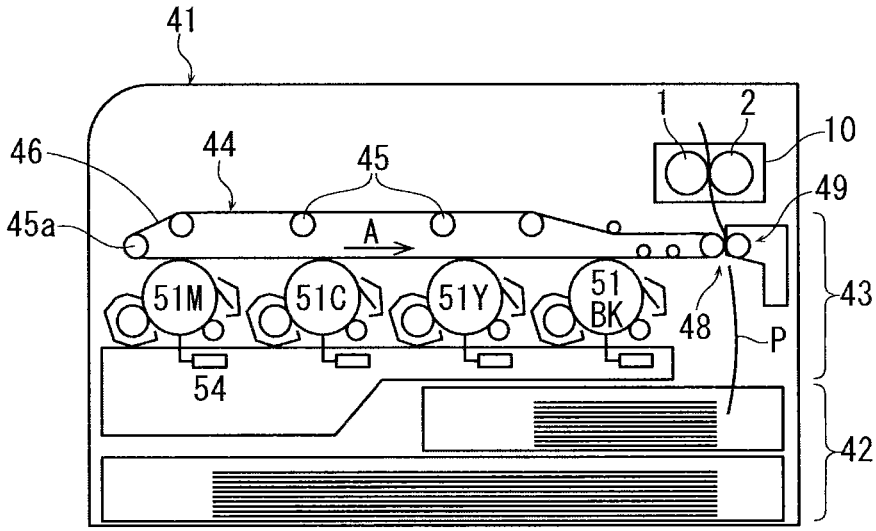
FIG. 1A is a schematic view illustrating a full color laser printer as one example of an image-forming apparatus including a fuser according to an embodiment of the present invention.

FIG. 1A is a schematic view illustrating a full color laser printer as one example of an image-forming apparatus including a fuser. This color laser printer includes a main body 41, a paper-feeding unit 42 including a two-level paper feeder provided in the lower portion of the main body 41, and an image-forming unit 43 provided above the paper-feeding unit 42. In FIG. 1A, the fuser is schematically illustrated.

Both of plain paper for use in copying and special paper having a heat capacity larger than that of plain paper such as an OHP sheet, heavy paper of 90K (basis weight: about 100 g/m$^2$ or more), for example, a card, or an envelope can be used in such a printer as a sheet-like recording medium.

The image-forming unit 43 includes a transfer belt unit 44 having the upper side as a paper-discharging side and the lower side as a paper-feeding side. The transfer belt unit 44 includes an endless transfer belt 46 wound around a roller group 45 including a not shown plurality of rollers. The transfer belt 46 rotates in the arrow A direction in response to the driving of one roller 47 in the roller group by a not shown driver.

Four image-forming units 51M, 51C, 51Y, 51Bk for magenta (M), cyan (C), yellow (Y) and black (Bk) are arranged under the transfer belt 46 in order from the upstream side of the transfer belt rotation direction (arrow A direction).

Figure 1B:
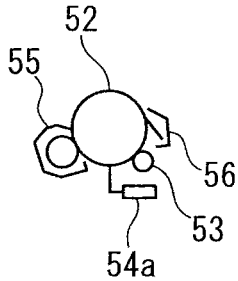
FIG. 1B is a view illustrating an inside portion of an image-forming unit.

Each of the image-forming units 51M, 51C, 51Y, 51Bk includes a photoreceptor 52 as an image carrier as illustrated in FIG. 1B. The photoreceptor 52 rotates and drives in the clockwise direction by a not shown driver.

A charging roller 53 as a charger, an optical writing section 54 which performs laser writing by an optical writing unit 54*a*, a development unit 55, and a cleaning unit 56 are provided around the photoreceptor 52. The development unit 55 is a two-component development unit, and supplies toners by a not shown toner supply unit according to the consumed toner amount.

The image-forming units 51M, 51C, 51Y, 51Bk form magenta, cyan, yellow and black images, respectively. These single color images are sequentially transferred on the circumferential face of the transfer belt 46 to be overlapped, so that color images are formed. Next, the color images are transferred on a recording member (recording medium) P from the transfer belt 46 by a first transfer roller 48 and a second transfer roller 49.

The image is pressed and heated in the nip portion between the fusing roller 1 and the pressure roller 2 in a fuser 10, so that the image is discharged on a not shown upper tray. This fuser 10 includes a characteristic constitution.

Hereinafter, the characteristic constitution of the fuser will be described.

Figure 2:
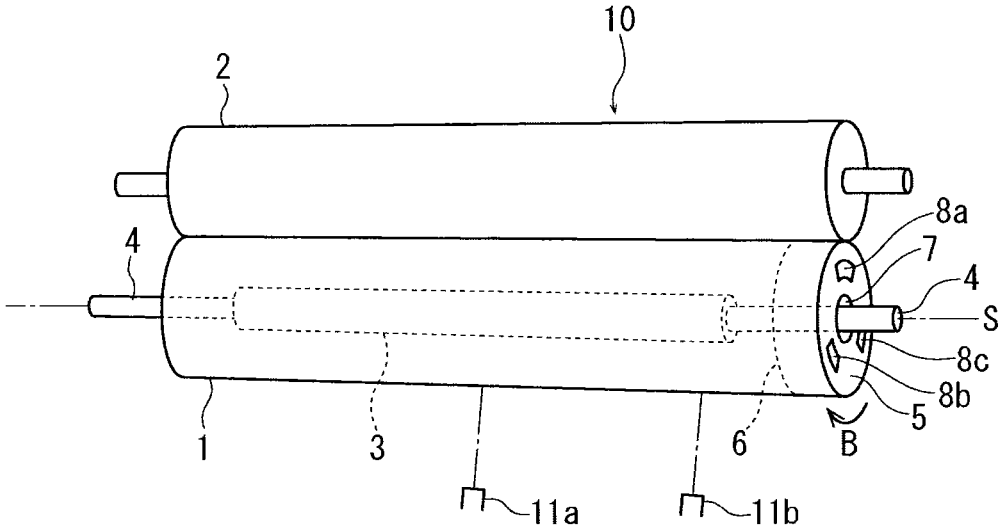
FIG. 2 is a perspective view illustrating one example of a fuser for describing a characteristic constitution of the fuser.

FIG. 2 is a perspective view illustrating one example of the fuser 10 for describing the characteristic constitution of the fuser. The fuser 10 includes a cylindrical fusing roller 1 (heating rotating body) having inside thereof a heater 3 as a heating source, and a pressure roller 2 (pressure rotating body) having a circumferential face which has contact with the fusing roller 1 to form a nip portion for fusing. The fusing roller 1 rotates in the arrow B direction by a not shown driver with a shaft center 4 as a rotation center (rotation axis S), and the pressure roller 2 rotates in response to the rotation of the fusing roller 1. A recording material P carrying an unfused toner image passes through the nip portion of the fuser 10, so that the toners are fused on the recording material P by the heat and pressure.

It is desirable to constantly maintain the temperature of the nip portion in order to stably fuse toners. For this reason, the surface temperature of the fusing roller 1 is detected by temperature detectors 11*a*, 11*b*, and intermittent power is supplied to the heater 3 by a not shown control circuit such that each temperature in the detected positions falls in a specified temperature range.

Since a sheet is generally fed in the center of the fusing roller 1 in the axial direction (generally referred to as center registration), the temperature in the end portions of the fusing roller 1, which are sheet non-passing portions, is increased if small size recording materials P are continuously fused for a long period of time. If the detection result of the temperature detector 11*b* reaches the upper limit of the specified temperature range due to the temperature increase, the power supply to the heater 3 is stopped, and the temperature of the entire fusing roller 1 is lowered in a state in which the temperature of the central portion of the fusing roller 1 in the axial direction is lower than that of the end portions of the fusing roller 1. Then, the detection result of the temperature detector 11*a* reaches the lower limit of the specified temperature range, and the power supply to the heater 3 is started. If the difference between the temperature of the central portion and the temperature of the end portion is large, the frequency of the ON-OFF switching of the power supply to the heater 3 is increased, so that flicker may occur.

A preferable temperature distribution in the axial direction can be maintained for a long period of time, and the flicker can be controlled by the characteristic constitution of the end portion of the fusing roller 1.

Figure 3:
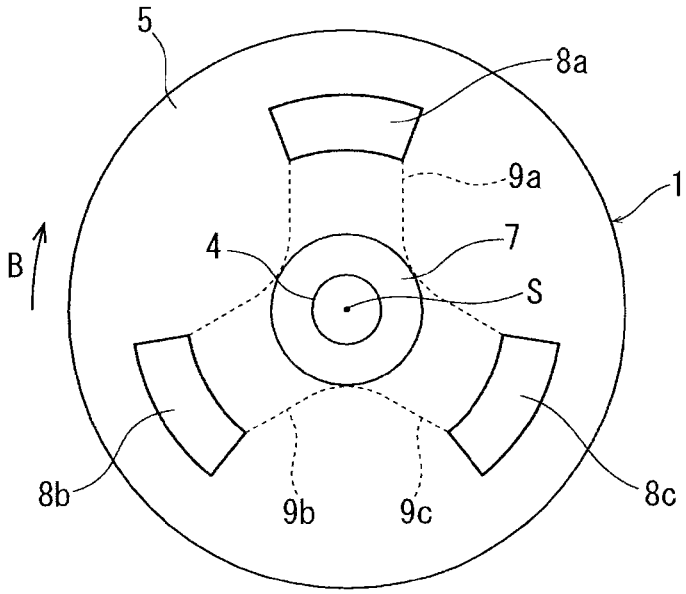
FIG. 3 is a right side view of a heating rotating body in the fuser illustrated in FIG. 2.

FIG. 3 is a right side view of the fusing roller 1 of the fuser 10 illustrated in FIG. 2. As illustrated in FIGS. 2, 3, a disk-like outside plate 5 which is exposed outside is provided in the end portion of the fusing roller 1. A disk-like inside plate 6 which faces the outside plate 5 at an interval and has contact with the inner circumferential face of fusing roller 1 is also provided in the fusing roller 1. The outside plate 5 includes a center vent 7 located near the rotation axis S and outer edge vents 8*a*, 8*b*, 8*c* located near the outer edge of the outside plate 5. Three flow paths of a flow path 9*a* which connects the center vent 7 and the outer edge vent 8*a*, a flow path 9*b* which connects the center vent 7 and the outer edge vent 8*b* and a flow path 9*c* which connects the center vent 7 and the outer edge vent 8*c* are formed between the outside plate 5 and the inside plate 6.

Upon the rotation of the fusing roller 1 in the arrow B direction by the operation of the fuser 10, the air in the flow paths 9*a*, 9*b*, 9*c* is pulled outside by the centrifugal force due to the rotation, and the flow of air current occurs from the center vent 7 to the outer edge vents 8*a*, 8*b*, 8*c*. The air in the end portion of the fusing roller 1 is cooled by the air flow, so that the increase in the temperature when small size recording materials are continuously fed, for example, can be controlled. Therefore, according to the present embodiment, the variations in the temperature distribution of the fusing roller 1 in the axial direction can be controlled with a simple constitution. As a result, flicker can be controlled.

The characteristic constitution of the fuser is described above with reference to FIGS. 2, 3, but the constitution illustrated in the figures is only an example, and the present invention is not limited to the above constitution.

The characteristic constitution of the end portion (hereinafter, referred to as an end portion temperature adjuster) including the outside plate 5, the inside plate 6 and the flow paths 9*a*, 9*b*, 9*c* provided between the outside and inside plates 5, 6 is only illustrated in the right side end portion in FIG. 2, but it can be provided in the left side end portion, and it can be definitely provided in both end portions. It is desirable to dispose the temperature adjuster in both end portions in a general center registration device. In a device (generally referred to as a side registration) in which a recording material is fed in any of the end portions of the fusing roller 1 in the axial direction, it is desirable to dispose the end portion temperature adjuster in the end portion opposite to the end portion in which the recording material is fed.

The position and the number of the center vents 7, outer edge vents 8*a*, 8*b*, 8*c* and the flow paths 9*a*, 9*b*, 9*c* connecting these are not especially limited. For example, the center vent is not limited to the above example, and it can be provided according to the number of flow paths, or a plurality of center vents and outer edge vents can be provided in each flow path. The number of flow paths is not limited to three. The entire space between the outside plate 5 and the inside plate 6 can be used as the flow path. The position of the center vent is not limited to the above example, and it can be provided in any position as long as it is located on the central axis side of the heating rotating body relative to the outer edge vent so as to generate air flow in the flow path with the centrifugal force. It is desirable to design the flow path with an appropriate constitution so as to achieve the effect of the present invention.

The heater 3 which heats from the inside of the fusing roller 1 is illustrated as a heating source, but a heating source which heats from the outside of the roller can be adopted as an electromagnetic induction heating method.

On the other hand, in the fuser including the end portion temperature adjuster illustrated in FIGS. 2, 3, if large size recording materials are continuously fed, the end portions are excessively cooled, and the temperature of the end portions may be lowered compared to the central portion. For this reason, it is desirable to appropriately change the number, size and position of the center vent and the outer edge vent, the shape, number and size of the flow path and the interval between the outside plate 5 and the inside plate 6 so as to obtain an appropriate efficiency.

It is preferable to provide between the outside plate and the inside plate a heat deformation member made of bimetal, which increases and decreases air flow volume flowing in the flow path in the rotation of the heating rotating body by a change in a curvature according to temperature. The cooling efficiency by the end portion temperature adjuster can be autonomously adjusted according to the temperature of the end portion of the heating rotating body by the heat deformation member. In the following example, a mechanism which adjusts the air flow volume flowing in the flow path by using the heat deformation member as a thermostatic member is sometimes referred to as a thermostatic flow volume adjuster.

The heat deformation member is made of bimetal in which two metal plates each having a different thermal expansion rate are bonded, and has a property in which its curvature is changed according to a change in temperature.

Since the thermostatic flow volume adjuster is provided in the fuser illustrated in FIGS. 2, 3, the cooling efficiency near the end portion of the fusing roller 1 can be autonomously controlled. Namely, the thermostatic flow volume adjuster is a mechanism which adjusts by using the shape change of the heat deformation member due to temperature such that the air flow volume in the flow paths 9*a*, 9*b*, 9*c* connecting the center vent 7 and the outer edge vents 8*a*, 8*b*, 8*c* is increased in response to an increase in temperature of the portion near the outside plate 5 and the inside plate 6 in the inner circumference face of the fusing roller 1 and is decreased in response to a decrease in such a temperature.

The cooling efficiency by cool air is appropriately adjusted according to the temperature of the end portion of the fusing roller 1 by the thermostatic flow volume adjuster, so that the variations in the temperature distribution of the fusing roller 1 in the axis S direction can be accurately controlled. As a result, flicker can be controlled.

Since the variations in the temperature distribution of the fusing roller 1 in the axial S direction are controlled, it is not necessary to use both of the temperature detectors 11*a*, 11*b* provided in the central portion and the end portion in the axis S direction. By reducing the number of temperature detectors, the device can be downsized and the costs can be lowered, and the constitution of the temperature control can be simplified.

In this case, the temperature detectors are not always necessary to be provided in the positions 11*a*, 11*b*, and they can be provided in any position in the axis S direction. The number of temperature detectors is not limited in view of the design, accuracy or the like.

The opening areas (zero, i.e., closed state) of the center vent 7 and the outer edge vents 8*a*, 8*b*, 8*c* and the sectional area (zero, i.e., blocked state) of at least a part of the flow paths 9*a*, 9*b*, 9*c* can be adjusted. By appropriately adjusting one of these areas or both of these areas with the deformation of the thermal deformation member according to temperature, the increase and decrease in the air flow volume in the flow paths 9*a*, 9*b*, 9*c* in the thermostatic flow volume adjuster can be appropriately adjusted. The increase and decrease in the air flow volume in the flow paths 9*a*, 9*b*, 9*c* can be appropriately adjusted by adjusting an opening degree of a valve provided in the flow paths 9*a*, 9*b*, 9*c* to block the air flow.

More specifically, the thermal deformation member is disposed in a position where at least a part of the thermal deformation member is deformed according to the temperature near the positions where the outside plate 5 and the inside plate 6 in the inner circumferential face of the fusing roller 1 are disposed. The opening areas of the center vent 7 and the outer edge vents 8*a*, 8*b*, 8*c*, the sectional area of at least a part of the flow paths 9*a*, 9*b*, 9*c*, the opening degree of the valve provided in the flow paths 9*a*. 9*b*, 9*c* or the like can be mechanically controlled in accordance with the deformation of the thermal deformation member according to temperature as the characteristic property of the deformation member. With this constitution, the thermostatic flow volume adjuster can be achieved with a simple constitution without using a complex electrical or mechanical constitution.

Hereinafter, the details of the fuser including the thermostatic flow volume adjuster will be described with reference to the following five embodiments. In the following embodiments, only one end portion provided with the end portion temperature adjuster in the heating rotating body is described, but the end portion temperature adjuster is actually provided in both end portions. Even if the following end portion temperature adjuster is provided in one end portion, such a constitution is certainly included within the scope of the present invention.

Embodiment 1

Figure 4:
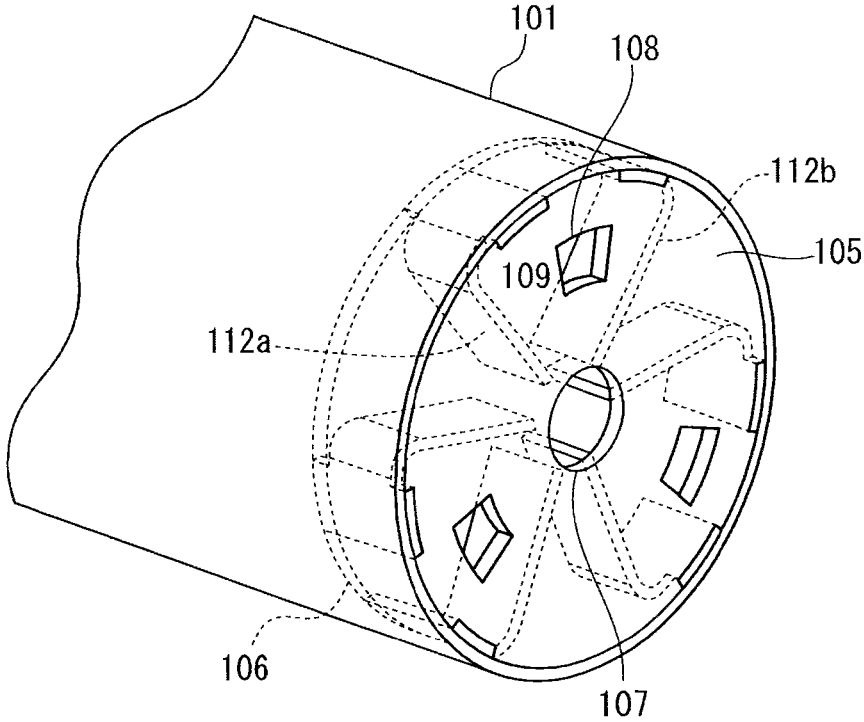
FIG. 4 is a perspective view illustrating the end portion of the heating rotating body in the fuser according to Embodiment 1.
Figure 5:
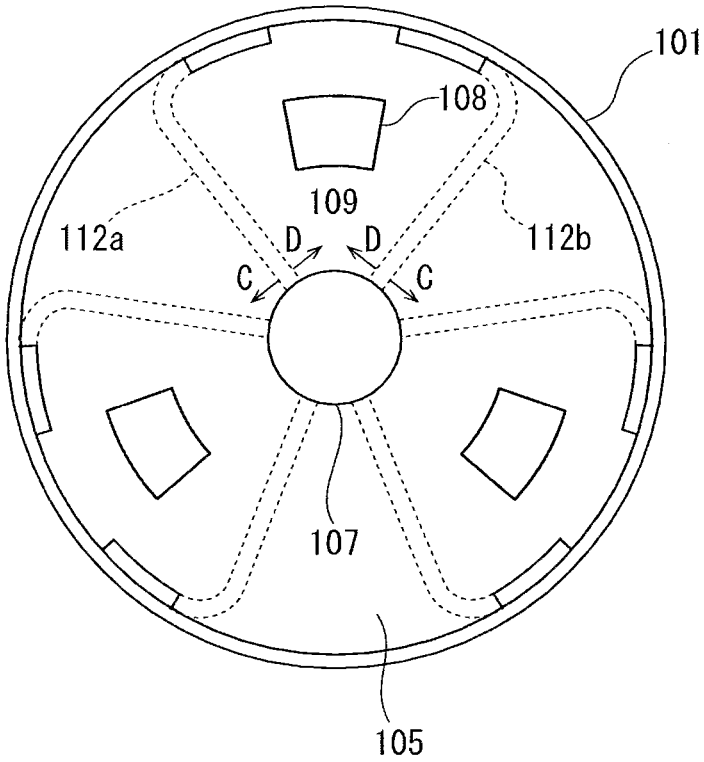
FIG. 5 is a right side view of the heating rotating body illustrated in FIG. 4.

FIG. 4 is a perspective view illustrating an end portion of a fusing roller 101 of a heating rotor in a fuser according to Embodiment 1. FIG. 5 is a right side view of the fusing roller 101 illustrated in FIG. 4.

As illustrated in these figures, in Embodiment 1, a disk-like outside plate 105 which is exposed outside is provided in the end portion of the fusing roller 101 in the rotation axis direction, and a disk-like inside plate 106 which has contact with the inner circumferential face of the fusing roller 101 is also provided in the fusing roller 101 on the inner side of the outside plate 105. Three pairs of thermal deformation plates (thermal deformation member) 112*a*, 112*b* are provided between the outside plate 105 and the inside plate 106.

A center vent 107 is provided near the center of the outside plate 105 (rotation axis of fusing roller 101), and three outer edge vents 108 are provided near the outer edge of the outside plate 105. Each pair of the thermal deformation plates 112*a*, 112*b* is radially arranged from the center vent 107. Each pair of the thermal deformation plates 112*a*, 112*b* includes therebetween the outer edge vent 108.

Figure 6:
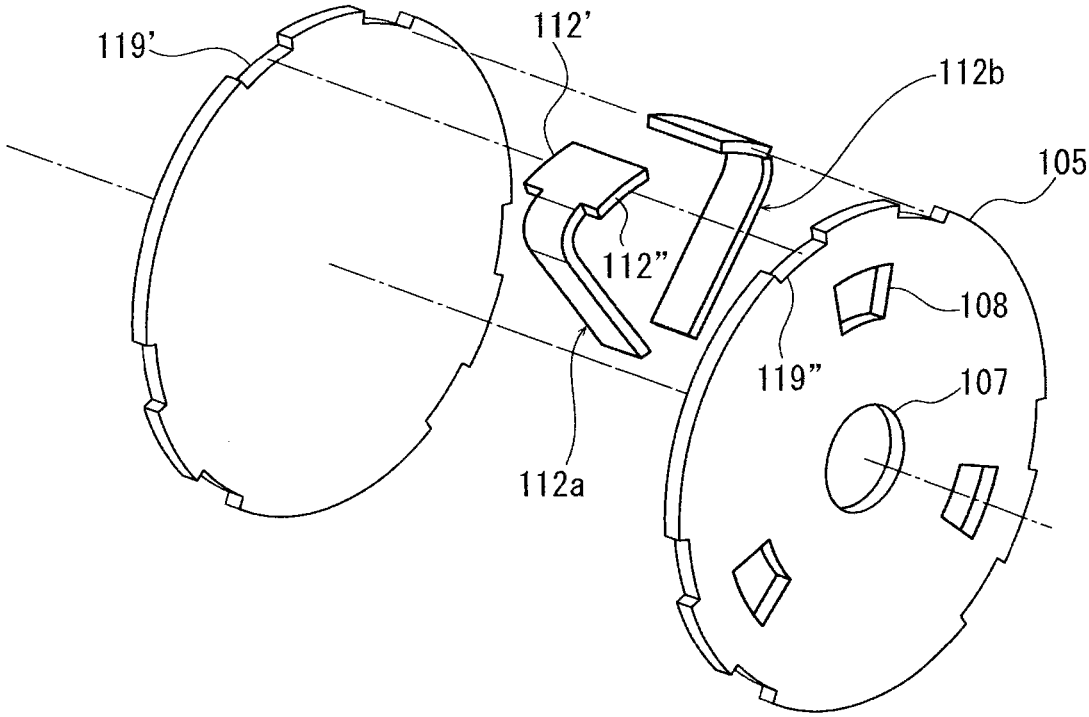
FIG. 6 is an exploded perspective view illustrating an end portion temperature adjuster in the heating rotating body illustrated in FIG. 4.

FIG. 6 is a perspective view of an end portion temperature adjuster in Embodiment 1. One pair of the thermal deformation plates 112*a*, 112*b* is only illustrated in FIG. 6.

The thermal deformation plates 112*a*, 112*b* are a pair of long plate-like members in which a curvature in the longitudinal direction increases according to a decrease in temperature (curvature radius decrease), and are made of bimetal. The inner surfaces of the curved thermal deformation plates face each other. Each of the thermal deformation plates 112*a*, 112*b* includes on the inner circumferential face of the fusing roller 101 end portions which are bent in the direction causing them to come close to each other. Each of the end portions includes on the side enlarged portions 112', 112". The enlarged portions 112', 112" fit to cutouts 119', 119" provided in the outer edges of the inside plate 106 and the outside plate 105 when the thermal deformation plates 112*a*, 112*b* are assembled to the fusing roller 101 together with the inside plate 106 and the outside plate 105. Then the thermal deformation plates 112*a*, 112*b* have contact with the inner circumferential face of the fusing roller 101 to be fastened to the fusing roller 101.

The long side portion of each of the thermal deformation plates 112*a*, 112*b* is provided to have contact with the outside plate 105 and the inside plate 106, or is provided close to the outside plate 105 and the inside plate 106 so as to be substantially vertical to the outside plate 105 and the inside plate 106. The space surrounded by the thermal deformation plates 112*a*, 112*b*, the outside plate 105 and the inside plate 106 (inner circumferential face of fusing roller 101) constitutes a flow path 109 which connects the center vent 107 and the outer edge vent 108.

Upon the rotation of the fusing roller 101 by the operation of the fuser, the air in the flow path 109 is pulled outside with the centrifugal force by the rotation, and the air flow from the center vent 107 to the outer edge vent 108 is generated. The outside air flows in the flow path 109 and is discharged from the inside portion by this air flow, and the end portion of the fusing roller 101 is cooled.

In this case, if small size recording materials are continuously fed, the temperature of the end portion of the fusing roller 101 is increased. The curvature of a pair of the thermal deformation plates 112*a*, 112*b* is decreased (curvature radius increase) due to the temperature increase, and the thermal deformation plates 112*a*, 112*b* are deformed in the arrow C direction in FIG. 5. As a result, the end portions of the thermal deformation plates 112*a*, 112*b* near the center vent 107 move away from each other, so that the width of the flow path 109 toward the center vent 107 is increased. Therefore, the air flow volume in that flow path 109 is increased; thus, the cooling efficiency of the end portion of the fusing roller 101 having an increased temperature is improved.

After that, if large size recording materials are continuously fed, the temperature of the end portions of the fusing roller 101 is decreased. The curvature of a pair of thermal deformation plates 112*a*, 112*b* is increased (curvature radius decrease) due to the temperature decrease, and the thermal deformation plates 112*a*, 112*b* are deformed in the arrow D direction in FIG. 5. As a result, the end portions of the thermal deformation plates 112*a*, 112*b* near the center vent 107 come close to each other, so that the width of the flow path 109 toward the center vent 107 is decreased. Therefore, the air flow volume in that flow path is decreased; thus, the cooling efficiency of the end portion of the fusing roller 101 having a decreased temperature is lowered. The thermal deformation plates 112*a*, 112*b* can be designed such that the end portions near the center vent 107 have contact with each other according to temperature so as to close the flow path 109.

According to Embodiment 1, since the air flow volume in the flow path 109 is autonomously controlled, the variations in the temperature distribution of the fusing roller 101 in the axial direction can be accurately controlled.

In Embodiment 1, the thermal deformation plates 112*a*, 112*b* corresponding to the thermal deformation members are individually constituted. However, they can be constituted as one member in which both of the thermal deformation plates 112*a*, 112*b* are continuously formed. In this case, the facing areas in one thermal deformation member are included in the constitution of "a pair of division plates" constituting the thermal deformation plate. Moreover, in this case, the center area of the plate-like member which has contact with the inner circumferential face of the fusing roller 101 to be fastened is a portion referred to as "the other end portion" of the thermal deformation member.

The thermal deformation plates 112*a*, 112*b* in which the curvature in the longitudinal direction is increased (curvature radius decrease) in accordance with a temperature decrease are described as the thermal deformation member in Embodiment 1. However, even if the opposite deformation, namely, a long plate-like member in which the curvature in the longitudinal direction is increased (curvature radius decrease) in accordance with a temperature increase is used, the fuser including a similar thermostatic flow volume adjuster can be obtained by arranging the plans opposite to the above constitution.

If a pair of long plate-like materials in which the curvature in the longitudinal direction (curvature radius decrease) is increased in accordance with an increase in temperature is used as thermal deformation members instead of the thermal deformation plates 112*a*, 112*b*, the outside surfaces of the curved materials are disposed to face each other. With this constitution, the curvature of the thermal deformation member in the longitudinal direction is increased in accordance with the temperature increase, and the flow path is expanded by the end portions which move away from each other, whereas the curvature of the thermal deformation member in the longitudinal direction is decreased in accordance with the temperature decrease, and the flow path is narrowed by the end portions which come close to each other.

In any case, the thermal deformation members are disposed to move backward from the flow path due to a temperature increase.

In Embodiment 1, the thermal deformation members are used for both of the thermal deformation plates 112*a*, 112*b* corresponding to the division plates of the flow path 109; however, one of the plates can constitute the thermal deformation member and the other of the plates can constitute a fastening division plate. Even with one thermal deformation member, the end portion of the thermal deformation member on the center vent side is deformed by the deformation of the thermal deformation member, and the width of the flow path formed between the facing thermal deformation member and the fastening division plate is changed in an area facing the center vent, so that it can be designed to operate similarly to that of the present embodiment.

Moreover, in Embodiment 1, the thermal deformation plates 112*a*, 112*b* as the thermal deformation members are disposed to face each other such that the outer edge vent 108 is arranged between the thermal deformation palates 112*a*, 112*b*, and are constituted as a pair of long division plates constituting the flow path 109. However, the thermal deformation plates 112*a*, 112*b* are not limited to the above embodiment. The width of the flow path can be changed by the thermal deformation member as long as the long plate-like member in which the curvature in the longitudinal direction is changed according to temperature is fastened in any position in the longitudinal direction (for example, end portion) and an unfastened portion (range between unfastened end portion and fastened portion) is arranged to move backward from the flow path side according to an increase in a temperature. Therefore, it can be designed to operate similarly to that of the present embodiment.

Embodiment 2

Figure 7:
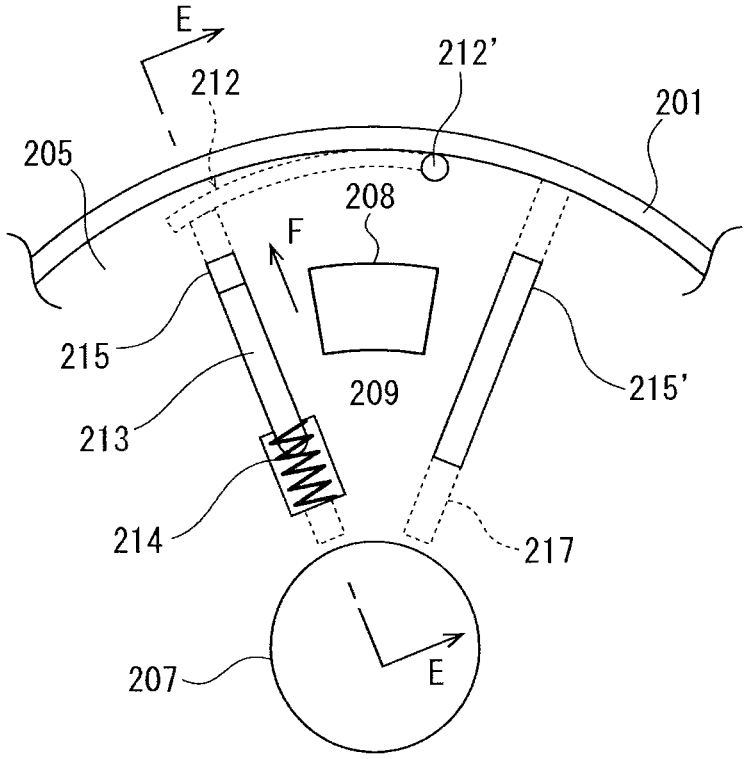
FIG. 7 is a schematic view illustrating a constitution of an end portion of a heating rotating body in a fuser according to Embodiment 2.

FIG. 7 is a schematic view illustrating a constitution of an end portion of a fusing roller 201 as a heating rotating body in a fuser according to Embodiment 2. FIG. 7 is an enlarged view as seen from an angle corresponding to FIG. 5.

In Embodiment 2, similar to Embodiment 1, three outer edge vents are provided, three flow paths are formed, and three pairs of end portion temperature adjusters are provided, but FIG. 7 illustrates only one pair of these.

Figure 8:
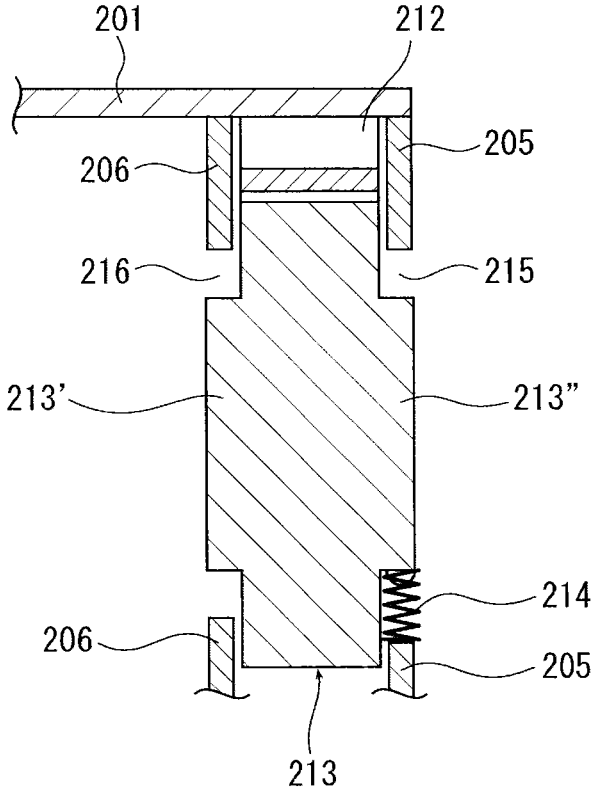
FIG. 8 is a sectional view along E-E line in FIG. 7.

FIG. 8 is a sectional view along an E-E line in FIG. 7.

As illustrated in these figures, in Embodiment 2, a disk-like outside plate 205 which is exposed outside is provided in the end portion of the fusing roller 101 in the rotation axis direction, and a disk-like inside plate 206 which has contact with the inner circumferential face of the fusing roller 101 is also provided in the fusing roller 101 on the inside of the outside plate 205. A thermal deformation plate (thermal deformation member) 212, a slidable division plate 213 and a fastening division plate 207 are provided at intervals between the outside plate 205 and the inside plate 206.

A center vent 207 is provided near the center of the outside plate 205 (rotation axis of fusing roller 201), and an outer edge vent 208 is provided near the outer edge of the outside plate 205. Six slits 216 (five slits are not illustrated) are radially provided in the inside plate 206 from the portion near the center vent 205 to the outer edge vent 208 and six slits 215, 215' (four slits are not illustrated) are provided in the outside plate 205 from the portion near the center vent 205 to the outer edge vent 208.

Figure 9A:
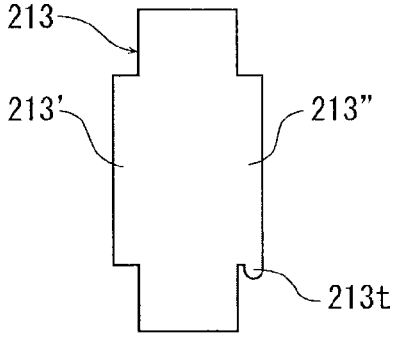
FIGS. 9A, 9B, 9C are views illustrating three members constituting a part of the end portion temperature adjuster.
Figure 9B:
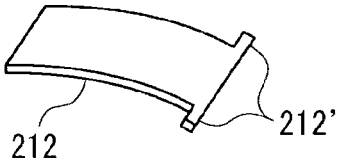
Figure 9C:
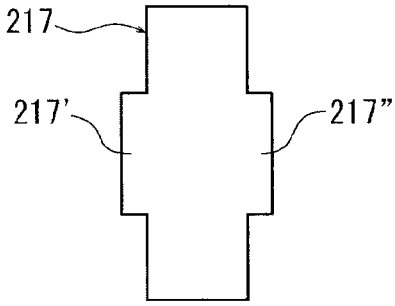

FIGS. 9A, 9B, 9C are views illustrating three members constituting a part of the end portion temperature adjuster. FIG. 9A is a plan view illustrating the slidable division plate 213, FIG. 9B is a perspective view illustrating the thermal deformation plate 212 and FIG. 9C is a plan view illustrating the fastening division plate 217.

The thermal deformation plates 212 are a pair of long plate-like materials in which the curvature in the longitudinal direction is increased (curvature radius decrease) according to a decrease in temperature. The thermal deformation plates 212 are made of bimetal, and include in one end portion thereof a projection 212'. The projection 212' is fitted to a hole provided in the outside plate 205 and the inside plate 206 in a state in which the outside face of the curved thermal deformation plate 212 faces the inner circumferential face of the fusing roller 201, so that the thermal deformation plate 212 is fastened to the inner circumferential face of the fusing roller 201 in a contact state (the projection 212' is fitted to the hole of the outside plate 205 in FIG. 7, and the inside plate 206 side is not illustrated in FIG. 7).

As illustrated in FIG. 9A, the slidable division plate 213 includes an approximately rectangular shape, and two long side provided with enlarged portion 213', 213". A projection 213*t* is provided in the end portion of the enlarged portion 213". The enlarged portion 213' is slidably fitted to a slit 216 provided in the inside plate 206 and the enlarged portion 213" is slidably fitted to a slit 215 provided in the outside plate 205. The end portion of the slidable division plate 213 on the inner circumferential side of the fusing roller 201 has contact with the end portion of the thermal deformation plate opposite to the projection portion 212' side. A spring (elastic body) 214 is fitted between the projection 213*t* and the end of the slit 215 on the center vent 207 side, and the spring 214 presses the slidable division plate 213 toward the thermal deformation plate, namely, in the arrow F direction.

As illustrated in FIG. 9C, the fastening division plate 217 includes an approximately rectangular shape, and two long side provided with enlarged portions 217', 217". The enlarged portion 217' is fitted to a not illustrated slit provided in the inside plate 206, the enlarged portion 217" is fitted to the slit 215' provided in the outside plate 205, and the end portion of the fastening division plate 217 on the inner circumferential side of the fusing roller 201 has contact with the inner circumferential face of the fusing roller 201, so that the fastening division plate 217 is fastened. The long sides of the fastening division plate 217 are fitted to the slit 215 and the not illustrated slit of the inside plate 206 to be fastened as a unified form.

By arranging each member as described above, the space surrounded by the slidable division plate 213, fastening division plate 217, outside plate 205 and inside plate 206 (inner circumferential face of fusing roller 201 and thermal deformation plate 212) constitutes a flow path 209 connecting the center vent 207 and the outer edge vent 208.

Upon the rotation of the fusing roller 201 by the operation of the fuser, the air in the flow path 209 is pulled outside with the centrifugal forcer by the rotation, so that the air flow from the center vent 207 side to the outer edge vent 208 side is generated. The outside air is flowed in the flow path 209 by this air flow, and is discharged from the inside portion; thus, the end portion of the fusing roller 201 is cooled.

If small size recording materials are continuously fed, the temperature in the end portion of the fusing roller 201 is increased. The curvature of the thermal deformation plate 212 is decreased due to the temperature increase (curvature radius increase), so that the unfastened end portion comes close to the inner circumferential face of the fusing roller 201. Then, the slidable division plate 213 which has contact with the deformed end portion slides in the direction of the inner circumferential face (arrow F direction in FIG. 7) of the fusing roller 201 by the pressing force of the spring 214. The end portion of the slidable division plate 213 near the center vent 207 moves away from the end portion of the fastening division plate 217, and the width of the flow path 209 toward the center vent 207 is increased. Therefore, the air flow volume in the flow path 209 is increased; thus, the cooling efficiency near the end portion of the fusing roller 201 having an increased temperature is improved.

Figure 10:
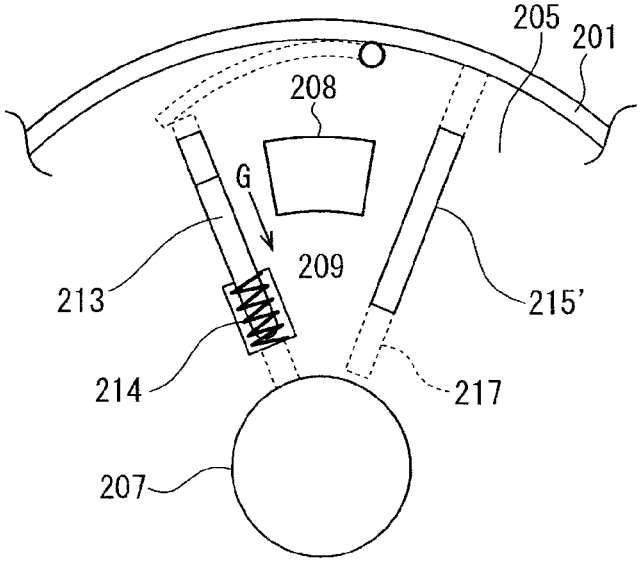
FIG. 10 is a schematic view illustrating an end portion constitution when the temperature of the end portion of the heating rotating body in FIG. 7 is lowered.

After that, if large size recording materials are continuously fed, the temperature in the end portion of the fusing roller 201 is decreased. The curvature of the thermal deformation plate 212 is increased due to the temperature decrease (curvature radius decrease), so that the unfastened end portion comes close to the center vent 207. Then, the slidable division plate 213 which has contact with the deformed end portion slides in the direction of the center vent 207 (arrow G direction in FIG. 10) against the pressing force of the spring 214. FIG. 10 is a schematic view illustrating the condition of the end portion when the temperature of the end portion of the fusing roller 201 illustrated in FIG. 7 is lowered.

The end portion of the slidable division plate 213 near the center vent 207 comes close to the end portion of the fastening division plate 217 by the sliding of the slidable division plate 213. Therefore, the width of the flow path 209 toward the center vent 207 is narrowed, and the air flow volume in the flow path 209 is decreased; thus, the cooling efficiency of the end portion of the fusing roller 201 having a decreased temperature is deteriorated.

The end portion of the slidable divisional plate 213 near the center vent 207 is arranged to have a space relative to the fastening division plate 217 even if it has a low temperature. However the slidable division plate 213 and the fastening division plate 207 can be designed to close the flow path 209 by the contact of the both plates.

According to Embodiment 2, the air flow volume in the flow path 209 is autonomously controlled, so that the variations in the temperature distribution of the fusing roller in the axial direction can be accurately controlled.

In Embodiment 2, the slidable division plate 213 is slidably disposed, but the fastening division plate 217 can be slidably constituted. In this case, the facing division plates are constituted to be line symmetric. By arranging the constitution which is line symmetric to the slidable partition plate 213 on the fusing division plate 217 side, the fuser having an operation similar to that of the present embodiment can be constituted. The thermal deformation member can be used for both of the division plates. The specific constitution which shears the thermal deformation plate will be described in the next Embodiment 3 and the modified example thereof.

The thermal deformation plate 212 in which the curvature in the longitudinal direction is increased (curvature radius decrease) in accordance with a temperature decrease is described as the thermal deformation member in Embodiment 3. However, even if the opposite deformation, namely, a long plate-like member in which the curvature in the longitudinal direction is increased (curvature radius decrease) in accordance with a temperature increase is used, the fuser including a similar thermostatic flow volume adjuster can be obtained by arranging the plan opposite to the above constitution.

If a long plate-like material in which the curvature in the longitudinal direction is increased (curvature radius decrease) in accordance with an increase in temperature is used as a thermal deformation member instead of the thermal deformation plate 212, the inside face of the curved thermal deformation member is disposed to face the inner circumferential face of the fusing roller 201. With this constitution, the curvature of the thermal deformation member in the longitudinal direction is increased in accordance with a temperature increase, the unfastened end portion comes close to the inner circumferential face of the fusing roller 201, and the flow path is expanded by the sliding of the slidable division plate 213 which has contact with the inner circumferential face of the fusing roller 201 in the inner circumferential face direction of the fusing roller 201 (arrow F direction in FIG. 7), whereas the curvature of the thermal deformation member in the longitudinal direction is decreased in accordance with a temperature decrease, the end portion comes close to the center vent 207, and the flow path is narrowed by the sliding of the slidable division plate 213 which has contact with the center vent 207 in the center vent 207 direction (arrow G direction in FIG. 10).

The thermal deformation member is disposed to come close to the inner circumferential face of the heating rotating body according to a temperature decrease in any event.

Embodiment 3

Figure 11:
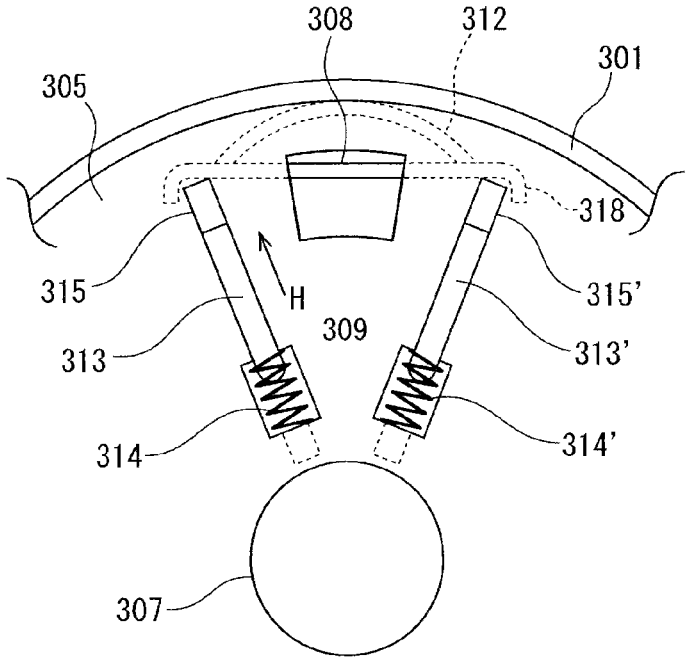
FIG. 11 is a schematic view illustrating a constitution of an end portion of a heating rotating body in a fuser according to Embodiment 3.

FIG. 11 is a schematic view illustrating a constitution of an end portion of a fusing roller 301 as a heating rotating body in a fuser according to Embodiment 3. FIG. 11 is an enlarged view as seen from an angle corresponding to FIG. 5.

In Embodiment 4, similar to Embodiment 1, three outer edge vents are provided, three flow paths are provided, and three pairs of end portion temperature adjusters are provided, but FIG. 11 illustrates only one pair of these.

A disk-like outside plate 305 which is exposed outside is provided to seal the end portion of the fusing roller 301 in the rotation axis direction. A not illustrated disk-like inside plate which has contact with the inner circumferential face of the fusing roller 301 is provided in the fusing roller 301 on the inside of the outside plate 305. A thermal deformation plate (thermal deformation member) 312, a top panel (movable division plate) 318 and slidable division plates (slidably arranged division plate) 313, 313' are provided between the outside plate 305 and the inside plate at intervals.

A center vent 307 is provided near the center of the outside plate 305 (rotation axis of fusing roller 301), and the outer edge vent 308 is provided near the outer edge of the outside plate 305.

The slidable division plate 313 has a shape and a constitution similar to those of the slidable division plate 213 in Embodiment 2, and is arranged to be slidable relative to the outside plate 305 and the not illustrated inside plate. An enlarged portion of the slidable division plate 313 is slidably fitted to a slit 315 provided in the outside plate 305, and a spring 314 (elastic body) is fitted between the edge of the slit 315 on the center vent 307 side and the projection provided in the enlarged portion of the slidable division plate 313, and the spring 314 presses the slidable division plate 313 in the inner circumferential direction (arrow H direction) of the fusing roller 301.

As described above, the slidable division plate 313 is arranged with the constitution similar to that of the slidable division plate 213 in Embodiment 2. However, the slidable division plate 313 in this embodiment is different from that in Embodiment 2 in that the end portion of the slidable division plate 313 has contact with the top plate 318, not the thermal deformation plate, as illustrated in FIG. 11.

In the present embodiment, the slidable division plate 313' is provided with the spring (elastic body) 314' instead of the fastening division plate 217 in Embodiment 2. The slidable division plate 313' and the spring 314' are arranged to face the slidable division plate 313 via the outer edge vent 308 provided in the outside plate 305. Actually, the slidable division plate 313' and the spring 314' are provided in the positions which are line symmetric to the slidable division plate 313 and the spring 314 with a standard which is a radius of the outside plate 305 and is a line passing through the center of the outer edge vent 308.

Since the slidable division plate 313' and the spring 314' have the constitutions including the contact with the top plate 318, which are similar to those of the slidable division plate 313 and the spring 314, except for the arrangement positions, the detailed descriptions thereof will be omitted.

The top plate 318 bridges the end portions of the slidable division plates 313, 313' on the inner circumferential surface side of the fusing roller 301, and is supported substantially vertical to the outside plate 305 and the not shown inside plate in a position which is exposed from the outside vent 308 in a state which has contact with or is close to the outside plate 305 and the not shown inside plate. The top plate 318 moves according to the sliding of the slidable division plates 313, 313'. Therefore, the top plate 318 is indirectly pressed on the inner circumferential face side of the fusing roller 301 by the spring 314, 314' via a pair of the slidable division plate 313, 313'. When a part of the top plate 318 exposes outside from the outer edge vent 308, a part of the outer edge vent 308 on the flow path 309 side communicates with the flow path 309. The area of the part of the outer edge vent 308, which communicates with the flow path 309, is changed according to the position of the top plate 318.

The thermal deformation plates 312 are a pair of long plate-like members in which the curvature in the longitudinal direction is increased according to a decrease in temperature (curvature radius decrease), and are made of bimetal. The inner surface of the curved surface faces the top plate 318, and both ends of the thermal deformation plate 312 have contact with the top plate 318, and the central portion of the outer surface of the curved surface has contact with the inner circumferential face of the fusing roller 301. The thermal deformation plate 312 is located between the top plate 318 and the inner circumferential face of the fusing roller 301.

The thickness between the top plate 318 and the inner circumferential face of the fusing roller 301, namely, the distance between the line connecting both ends of the thermal deformation plate (corresponding to the contact surface of the top plate 318) and the center point of the thermal deformation plate 312 in the longitudinal direction (the contact point with the fusing roller 301) changes according to the curvature degree of the thermal deformation plate 312. The thickness increases according to a decrease in a temperature whereas the thickness decreases according to an increase in temperature.

By arranging each member as described above, the space surrounded by a pair of slidable division plates 313, 313', the top plate 318, the outside plate 305 and the inside plate 306 constitutes the flow path 309 connecting the center vent 307 and the outer edge vent 308. Therefore, the area of the outer edge vent 308 on the inner circumferential face side of the fusing roller 301 becomes a closed area by the top plate 318, and the area of the outer edge vent 308 on the center vent 307 side becomes an open area.

Upon the rotation of the fusing roller 301 by the operation of the fuser, the air in the flow path 309 is pulled outside by the centrifugal force with the rotation, so that the air flow from the center vent 307 to the outer edge vent 308 is generated. Owing to this air flow, the outside air flows in the flow path 309 and is discharged from the inside portion. Therefore, the end portion of the fusing roller 301 is cooled.

In this case, if small size recording materials are continuously fed, the temperature of the end portion of the fusing roller 301 is increased. The curvature of the thermal deformation plate 312 is lowered (curvature radius increase) due to the temperature increase, and the thickness is decreased. Therefore, the slidable division plates 313, 313' slide in the inner circumferential direction of the fusing roller 301 (arrow H direction in FIG. 11) by the pressure of the springs 314, 314', and the top plate 318 moves in the inner circumferential face direction of the fusing roller 301 according to the sliding. Then, the end portions of the slidable division plates 313, 313' near the center vent 307 move away from each other. For this reason, the width of the flow path 309 toward the center vent 307 is expanded, the opening area of the outer edge vent 308 is increased by the movement of the top plate 318, and the air flow volume in the flow path 309 is increased. Thus, the cooling efficiency of the end portion of the fusing roller 301 having an increased temperature is improved.

Figure 12:
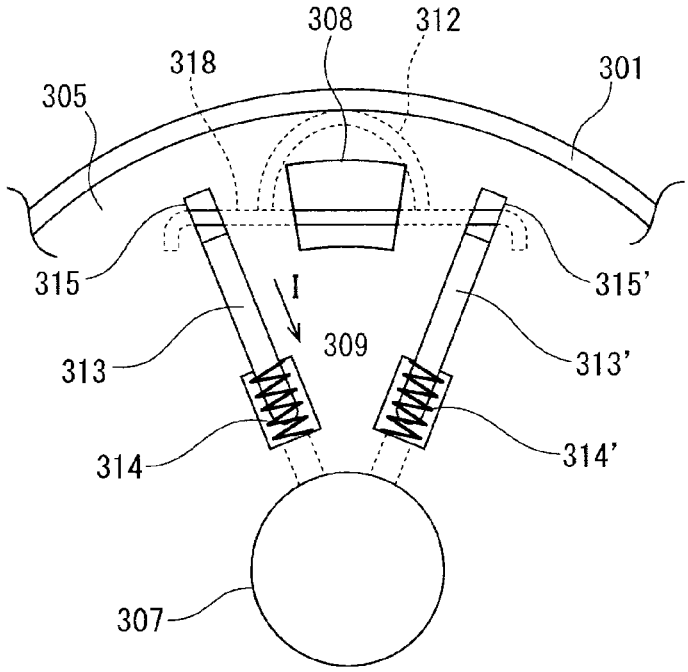
FIG. 12 is a schematic view illustrating an end portion constitution when the temperature of the end portion of the heating rotating body illustrated in FIG. 11 is lowered.

After that, if large size recording materials are continuously fed, the temperature of the end portion of the fusing roller 301 is decreased. The curvature of the thermal deformation plate 312 is increased (curvature radius decrease) due to the temperature decrease, and the thickness is increased, so that the slidable division plates 313, 313' slide in the center vent 307 direction (arrow I direction in FIG. 12) against the pressure of the springs 314, 314', and the top plate 318 moves in the center vent 307 direction according to the sliding. FIG. 12 is a schematic view illustrating the constitution of the end portion of the fusing roller 301 when the temperature of the end portions of the fusing roller 301 illustrated in FIG. 11 is decreased.

The end portions of the slidable division plates 313, 313' near the center vent 307 come close to each other by the sliding of the slidable division plate 313, 313', the width of the flow path 309 toward the center vent 307 is narrowed, and the opening area of the outer edge vent 308 is decreased according to the movement of the top plate 318. For this reason, the cooling efficiency of the end portion of the fusing roller 301 having a decreased temperature is deteriorated because the air flow volume in the flow path 309 is decreased.

The end portions of the slidable division plates 313, 313' near the center vent 307 are arranged to maintain a space therebetween even at a low temperature, but they can be arranged to have contact with each other so as to close the flow path 309 according to temperature. Similarly, the opening area of the outer edge vent 308 can be set to zero by moving the top plate 318 on the center vent 307 side.

As described above, according to Embodiment 3, since the air flow volume in the flow path 309 is autonomously controlled, the variations in the temperature distribution of the fusing roller 301 in the axial direction can be accurately controlled with a simple constitution.

In this embodiment, both ends of the thermal deformation plate 312 have contact with the top plate 318 and the central portion of the outer surface of the curved surface has contact with the inner circumferential face of the fusing roller 301. However, the thermal deformation plate 312 can be arranged such that both ends of the thermal deformation plate 312 have contact with the inner circumferential face of the fusing roller 301 and the center of the outer surface has contact with the top plate 318. Even with this constitution, the fuser having a similar operation can be constituted because the change in the thickness according to the curvature change is used in this embodiment.

The opening area of the outer edge vent 308 can be increased and decreased by a constitution which directly presses the top plate 318 in the direction of the inner circumferential face of the fusing roller 301 by elastic members such as springs 314, 314' without arranging the slidable division plates 313, 313'. Therefore, the opening area of the outer edge vent can be increased and decreased similar to the present embodiment even if the flow path is formed by a fastening division plate and a movable division plate such as the top plate, and the slidable division plate is directly pressed by the elastic members.

In Embodiment 3, the thermal deformation plate 312 corresponding to a thermal deformation member is fitted between the top plate 318 corresponding to a movable division plate and the inner circumferential face of the fusing roller 301 corresponding to a heating rotating body. The fitting position of the thermal deformation member is not limited thereto. The surface facing the movable division plate is not limited to the inner circumferential face of the heating rotating body, and it can be a surface (a surface parallel to the movable division plate projecting from the outside plate) fastened to the outside plate. By fitting the thermal deformation member between the fastened surface and the movable division plate, the opening area of the outer edge vent can be increased and decreased similar to the present embodiment.

In this case, the moving direction of the movable division plate is not limited to the radial direction of the outside plate or the approximate vertical direction of the movable division plate. The movable division plate can be supported at any angle as long as the movable division plate can be moved in the inward and outward direction of the flow path in a position where a part of the movable division plate 318 is exposed to the outer edge vent. By fitting the thermal deformation plate between such a movable division plate and the surface fastened to the outside plate facing the movable division plate, a fuser similar to that in the present embodiment can be obtained.

As described in the present embodiment, the moving direction of the movable division plate is the approximate radial direction of the outside plate and the approximate vertical direction of the movable division plate, and the surface fastened to the outside plate is the inner circumferential face of the heating rotating body. With this constitution, the thermal deformation plate has contact with the inner circumferential face of the end portion of the heating rotating body, and effectively reacts to the temperature change in the end portion of the heating rotating body, so that the air flow volume in the flow path is autonomously controlled. Accordingly, the variations in the temperature distribution of the heating rotating body in the axial direction can be accurately controlled with a simple constitution.

The fuser having the operation similar to that of the present embodiment can be obtained even if the thermal deformation plate in which one end or the neighborhood thereof is fastened to the inner circumferential face or the neighborhood thereof of the fusing roller 301 and the other end has contact with the top plate 318 is used as the thermal deformation plate 212 in Embodiment 2 as the modified example, in addition to the thermal deformation plate fitted between the movable division plate and the face facing that plate. Namely, the unfastened end portion comes close to the side of the inner circumferential face of the fusing roller 301 due to a decrease in temperature and comes close to the side of the center vent 207 due to an increase in temperature, so that the end portion has contact with the top plate 318. Therefore, the fuser having the operation and effect similar to those in the present embodiment can be obtained.

In this modified example, similar to Embodiment 2, the thermal deformation plate can be arranged such that its inner surface faces the top plate or its outer surface faces the top plate.

In this modified example, one end or the neighborhood thereof of the thermal deformation member is fastened to the inner circumferential face or the neighborhood thereof of the heating rotating body. However, the one end or the neighborhood thereof of the thermal deformation plate can be fastened to the outside plate. With this constitution, the opening area of the outer edge vent can be increased or decreased similar to the present embodiment.

In this case, the moving direction of the movable division plate is not limited to the approximate radial direction of the outside plate or the approximate vertical direction of the movable division plate. The movable division plate can be supported at any angle as long as the movable division plate can be moved in the inward and outward direction of the flow path in a position where a part of the movable division plate 318 is exposed to the outer edge vent. By maintaining the unfastened end portion or the neighborhood thereof of the thermal deformation plate to have contact with the movable division plate from the outside of the flow path, a fuser similar to that in the present embodiment can be obtained.

As described in the modified example, the moving direction of the movable division plate is the approximate radial direction of the outside plate and the approximate vertical direction of the movable division plate, and the portion fastened to the thermal deformation plate is the inner circumferential face or the neighborhood thereof of the heating rotating body. With this constitution, the thermal deformation plate has contact with or comes close to the inner circumferential face of the end portion of the heating rotating body, and effectively reacts to the temperature change in the end portion of the heating rotating body, so that the air flow volume in the flow path is autonomously controlled. Accordingly, the variations in the temperature distribution of the heating rotating body in the axial direction can be accurately controlled with a simple constitution.

Embodiment 4

Figure 13:
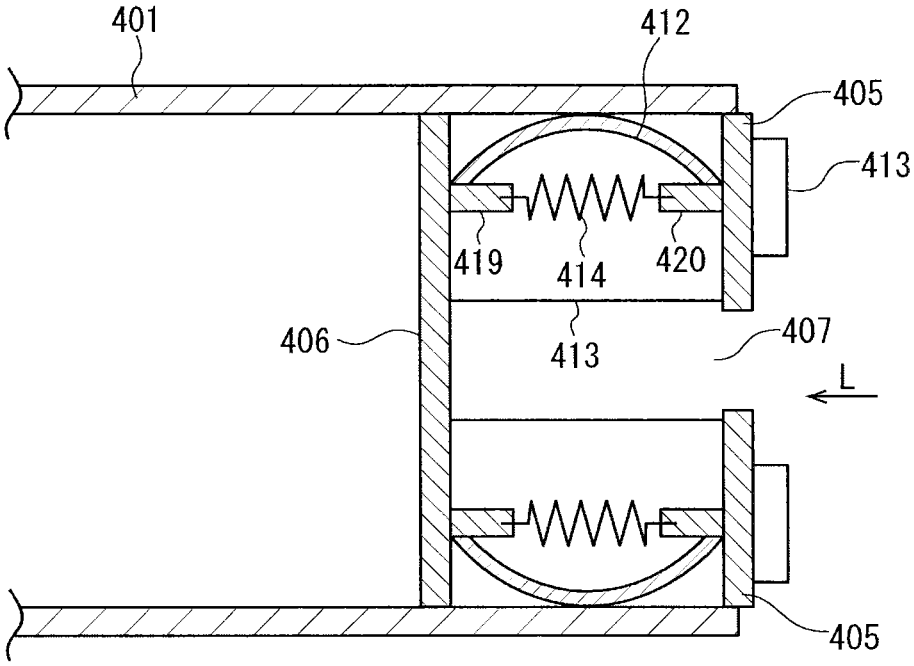
FIG. 13 is a schematic view illustrating a constitution of an end portion of a heating rotating body in a fuser according to Embodiment 4.

FIG. 13 is a schematic view illustrating a constitution of an end portion of a fusing roller 401 as a heating rotating body in a fuser according to Embodiment 4. FIG. 13 is a sectional view illustrating the end portion of the fusing roller 401. This embodiment describes a pair of end portion temperature adjusters arranged up and down.

As illustrated in FIG. 13, in Embodiment 4, a disk-like outside plate 405 which is exposed outside is provided in the end portion of the fusing roller 401 in the rotation axis direction. A disk-like inside plate 406 which has contact with the inner circumferential face of the fusing roller 401 is also provided in the fusing roller 401 on the inside of the outside plate. A thermal deformation plate (thermal deformation member) 412, division plate 413, and spring (elastic body) 414 are provided at intervals between the outside plate 405 and the inside plate 406.

Figure 14:
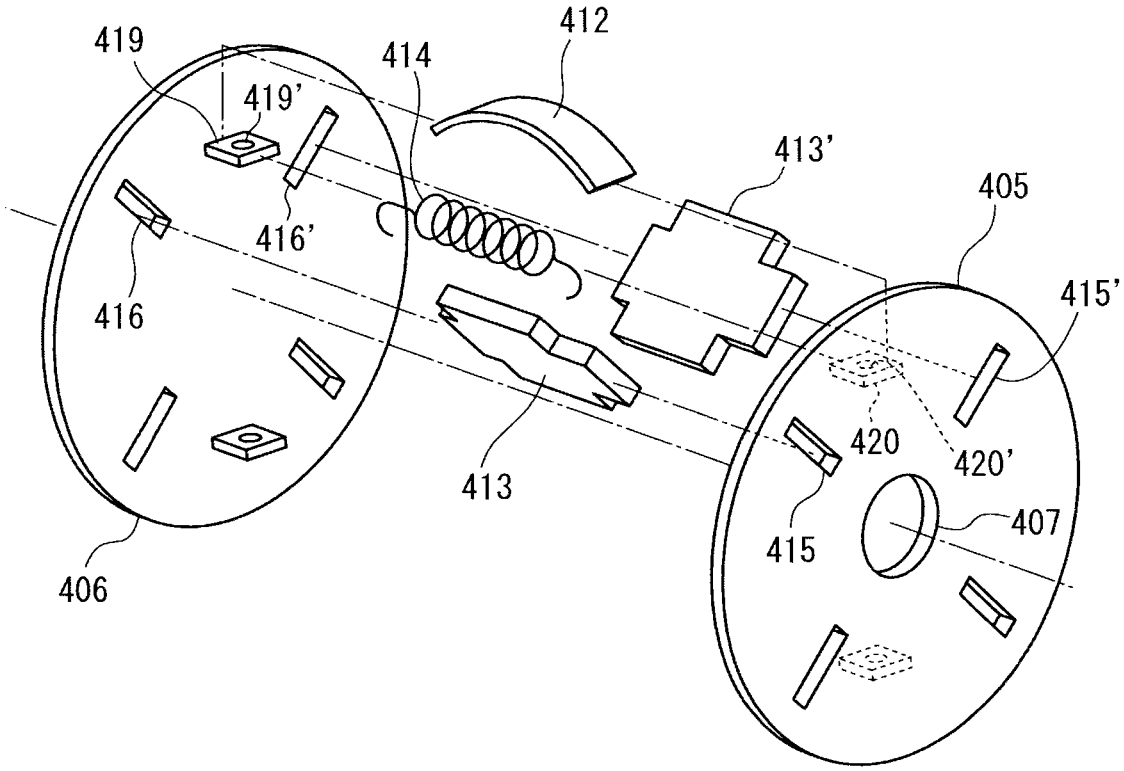
FIG. 14 is a perspective view illustrating an end portion temperature adjuster in the heating rotating body illustrated in FIG. 13.

FIG. 14 is a perspective view illustrating a member constituting the end portion temperature adjuster. In this embodiment, one of the end portion temperature adjusters is illustrated.

As illustrated in FIG. 14, a pair of division plates 413, 413' is provided between the outside plate 405 and the inside plate 406 to be vertical to these plates.

A center vent 407 is provided near the center of the outside plate 405 (rotation axis of fusing roller 401), similar to the other embodiments, but a hole corresponding to the outer edge vent is not provided near the outer edge of the outside plate 405 in this embodiment.

The inside plate 406 includes four slits having slits 416, 416' and the outside plate 405 includes four slits having slits 415, 415'. These slits are radially provided from the neighborhood of the center vent 205. Enlarged portions provided in the division plate 413 fit to the slits 415, 416 and enlarged portions provided in the division plate 413' fit to the slits 415, 415'.

The slits 416, 416' and the enlarged portions of the division plates 413, 413' are unified by the fitting and fastening, and the position of the inside plate 406 in the rotation axis direction of the fusing roller 401 is fastened. In contrast, the slits 415, 415' and the enlarged portions of the division plates 413, 413' are not fastened, and the outside plate 405 is supported to be movable in the rotation axis direction of the fusing roller 401 (direction opposite to arrow L direction in FIG. 13).

A projection 419 toward the outside plate 405 is provided between a pair of slits 416, 416' of the inside plate 406. The projection includes a hole 419'. A projection 420 toward the inner plate 406 is provided between a pair of slits 415, 415' of the outside plate 405 in the position corresponding to the projection 419. The projection 420 includes a hole 420'. Both ends of a spring 414 (elastic body) are hooked to the holes 419', 420', and the inside plate 406 and the outside plate 405 are pulled by the spring 414.

The thermal deformation plate 412 is provided between the inside plate 406 and the outside plate 405 along the spring 414. The thermal deformation plate 412 is a pair of long plate-like members in which the curvature in the longitudinal direction is increased in accordance with a decrease in temperature (curvature radius decrease), and is made of bimetal. One end of the thermal deformation plate 412 has contact with the inside plate 406 and the other end of the thermal deformation plate 405 has contact with the outside plate 405.

The thermal deformation plate 412 prevents the inside and outside plates 405, 406 from being pulled by the spring 414 in the fuser of this embodiment. The interval between both plates coincides with the entire length (distance between end portions) of the thermal deformation plate 412, which curves according to temperature.

Figure 15:
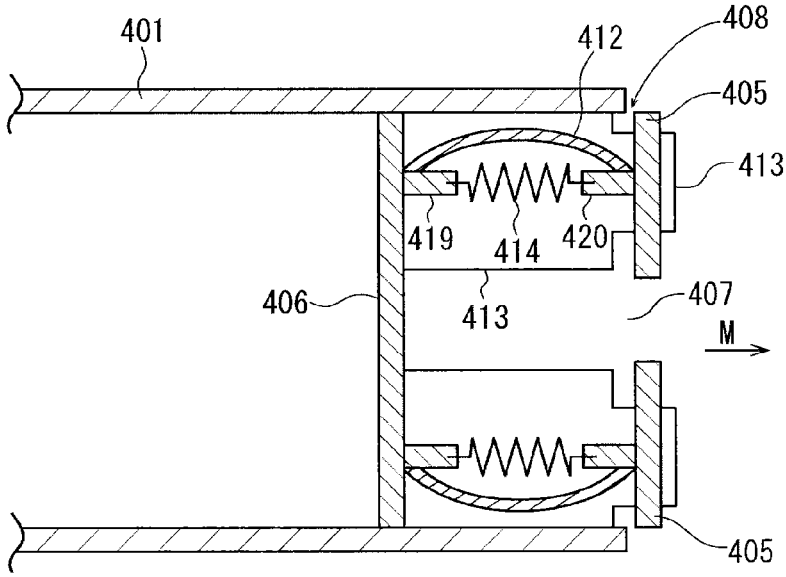
FIG. 15 is a schematic view illustrating an end portion constitution when the temperature of the end portion of the fusing roller 401 illustrated in FIG. 13 is increased.

In a low temperature condition illustrated in FIG. 13, the curvature of the thermal deformation plate 412 in the longitudinal direction is high (small curvature radius), the entire length is short, and an interval between the inside plate 406 and the outside plate 405 is narrow. The outside plate 405 is housed in the fusing roller 401. On the other hand, in a high temperature condition illustrated in FIG. 15, the curvature of the thermal deformation plate 412 in the longitudinal direction is low (large curvature radius), the entire length is long, and the interval between the inside plate 406 and the outside plate 405 is increased. The outside plate 405 moves in a position (arrow M direction) projecting from the end portion of the fusing roller 401. FIG. 15 is a schematic view illustrating the condition of the end portion of the fusing roller 401 when the temperature in the end portion of the fusing roller 401 illustrated in FIG. 13 is increased.

As illustrated in FIG. 15, if the outside plate 405 is located in the position projecting from the end portion of the fusing roller 401, the interval 408 is formed between the outside plate 405 and the edge of the fusing roller 401. This interval constitutes the outer edge vent. The entire interval between the inside and outside plates 406, 407 constitutes a flow path connecting the center vent 407 and the interval 408 constituting the outer edge vent.

Upon the rotation of the fusing roller 401 by the operation of the fuser, if small size recording materials are continuously fed, the temperature of the end portion of the fusing roller 401 is increased. The curvature of the thermal deformation plate 412 is lowered (curvature radius increase) due to the temperature increase, so that the outside plate 405 moves in the arrow M direction to project from the end portion of the fusing roller 401 as illustrated in FIG. 15, and the interval 408 is formed. Then, the air in the flow path connecting the center vent 407 and the interval 408 is pulled outside with the centrifugal force by the rotation of the fusing roller 401, the airflow from the center vent 407 to the interval 408 is generated, the outside air flows in the flow path and is discharged from the inside, and the end portion of the fusing roller 401 is cooled. The curvature of the thermal deformation plate 412 is lowered as the temperature is increased, and the projection amount of the outside plate 405 from the end portion of the fusing roller 401 is increased, so that the opening area of the interval 408 is increased. Therefore, the air flow volume in the flow path is increased, and the cooling efficiency of the end portion of the fusing roller 401 is further improved.

After that, if large size recording materials are continuously fed, the temperature of the end portion of the fusing roller 401 is decreased. The curvature of the thermal deformation plate 412 is increased as the temperature is lowered, the outside plate 405 is moved in the arrow L direction, and the projection amount of the outside plate 405 from the end portion of the fusing roller 401 is reduced. For this reason, the opening area of the interval 408 is reduced, so that the air flow volume in the flow path is decreased, and the cooling efficiency of the end portion of the fusing roller 401 having an increased temperature is lowered. In a further lowered temperature condition, as illustrated in FIG. 13, the curvature of the thermal deformation plate 412 is further increased, the outside plate 405 is housed in the fusing roller 401, the interval 408 in FIG. 15 is disappeared, and the air does not flow in the flow path; thus, the cooling efficiency by cold air is lost.

As described above, according to Embodiment 4, the air flow volume in the flow path (including zero flow volume in this embodiment) is autonomously controlled, so that the variations in the temperature distribution of the fusing roller 401 in the axial direction can be accurately controlled.

Embodiment 5

Figure 16:
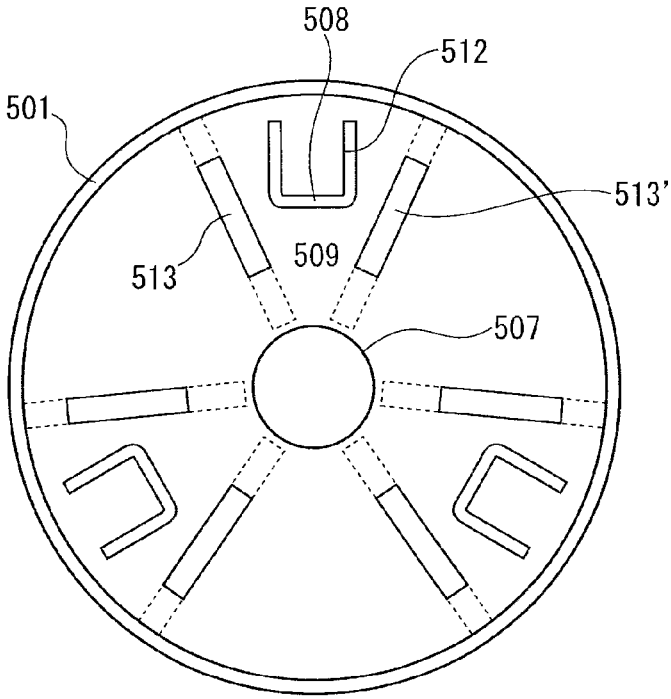
FIG. 16 is a schematic view illustrating an end portion constitution of a heating rotating body in a fuser according to Embodiment 5.

FIG. 16 is a schematic view illustrating a constitution of an end portion of a fusing roller 501 as a heating rotating body in a fuser according to Embodiment 5. FIG. 5 is a view as seen from an angle corresponding to FIG. 5.

Figure 17:
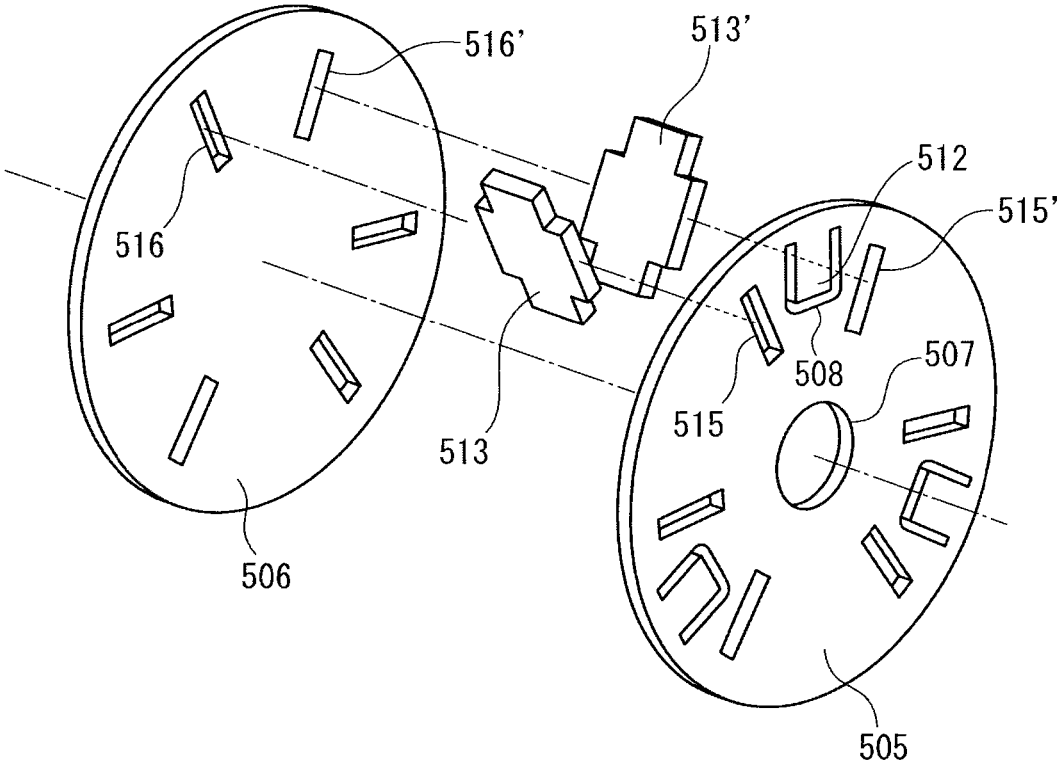
FIG. 17 is an exploded perspective view illustrating an end portion temperature adjuster in a heating rotating body illustrated in FIG. 16.

FIG. 17 is a perspective view illustrating members constituting an end portion temperature adjuster in this embodiment. In this figure, one pair of division plates 513, 513' out of three pairs is only illustrated.

As illustrated in these figures, in Embodiment 5, a disc-like outside plate 505 which is exposed outside is provided in the end portion of the fusing roller 501 in the rotation axis direction. A disc-like inside plate 506 which has contact with the inner circumferential face of the fusing roller 501 is provided in the fusing roller 501 on the inside of the outside plate 505. Three pairs of division plates 513, 513' are provided between the outside plate 505 and the inside plate 506 at intervals.

A center vent 507 is provided near the center of the outside plate 505 (rotation axis of fusing roller 501), and three outside vents 508 are provided near the outer edge of the outside plate 505. Each pair of the division plates 513, 513' is radially provided from the neighborhood of the center vent 507 to include therebetween the outside vent 508.

Since the shape and the constitution of the division plates 513, 513' and the connection between the inside and outside plates 506, 505 are similar to those in Embodiment 2, the detailed description thereof will be omitted.

In this embodiment, a plate-like thermal deformation piece (thermal deformation member, plate-like piece) 512 is connected to the opening portion of the outside vent 508.

Figure 18:
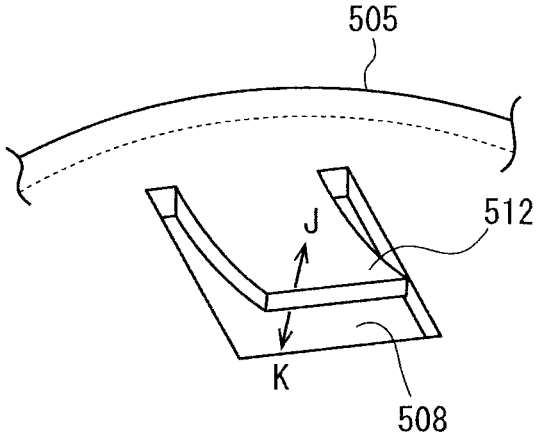
FIG. 18 is an enlarged perspective view illustrating a circumference of an outer edge vent in the heating rotating body illustrated in FIG. 16.

FIG. 18 is an enlarged view illustrating a circumferential portion of the outside vent 508.

The thermal deformation piece 512 is a plate-like metal piece in which the curvature is increased (curvature radius decrease) according to an increase in temperature, and is in general a bimetal member. A non-curved one side is fastened to the end of the outside vent 508, and is disposed in a position which closes a part of the outer edge vent 508 as a whole at a low temperature. In this case, a low temperature is a temperature which is lower than a temperature of the thermal deformation piece 512 in the lower limit of the setting temperature range of the fusing roller 501. The temperature can not be unambiguously defined because the temperature is changed according to various conditions such as the position of the outer edge vent, the selection of various materials and the constitutions.

The connection between the thermal deformation piece 512 and the outside plate 505 is performed by means of welding, bonding or screwing, or they can be integrally molded by a different material. It is not necessary for the thermal deformation member to bend in the longitudinal direction by the thermal deformation. The short side of the thermal deformation can be bent, and the thermal deformation plate can be a square material. Any thermal deformation plate can be used as long as one side which does not curve is fastened to the end of the outer edge vent.

By disposing each member as described above, the space surrounded by the division plates 513, 513', outside plate 505 and inside plate 506 (inner circumferential face of fusing roller 501) constitutes a flow path 509 connecting the center vent 507 and the outside vent 508.

Upon the rotation of the fusing roller 501 by the operation of the fuser, the air in the flow path 509 is pulled outside with the centrifugal force by the rotation, and the air flow flowing to the outside vent 508 from the center vent 507 is generated. By this air flow, the outside air flows in the flow path 509 and is discharged from the inside, and the end portion of the fusing roller 501 is cooled.

In this case, if small size recording materials are continuously fed, the temperature near the end portion of the fusing roller 501 is increased. The curvature of the thermal deformation piece 512 is increased (curvature radius decrease) due to the temperature increase, and the thermal deformation piece 512 is turned in the J direction. Then, the thermal deformation plate 512 located to close a part of the outside vent 508 is moved back, and the opening area of the outer edge vent 508 is increased, and the air flow volume is increased, so that the cooling efficiency of the end portion of the fusing roller 201 having an increased temperature is improved.

After that, if large size recording materials are continuously fed, the temperature of the end portion of the fusing roller 501 is decreased. The curvature of the thermal deformation piece 512 is decreased (curvature radius increase) due to the temperature decrease, and the thermal deformation piece is turned in the arrow K direction. Then, the thermal deformation piece 512 moved back from the outer edge vent 508 is moved in the direction which closes a part of the outer edge vent 508, the opening area of the outer edge vent 508 is reduced, and the air flow volume is decreased, so that the cooling efficiency of the end portion of the fusing roller 501 having a decreased temperature is deteriorated.

In this embodiment, the thermal deformation piece 512 is arranged to have a space relative to the outer edge vent 508 even at a low temperature, but it can be designed to obtain a zero opening area by the contact with the outer edge vent 508.

According to the present embodiment, the air flow volume in the flow path 509 is autonomously controlled, so that the variations in the temperature distribution of the fusing roller 501 in the axial direction can be accurately controlled with a simple constitution.

In this embodiment, the thermal deformation piece 512 in which the curvature is increased according to an increase in temperature (curvature radius decrease) is used as a thermal deformation member, but the same constitution can be obtained by using a thermal deformation piece in which the curvature is decreased according to an increase in temperature (curvature radius increase). In this case, the connection angle of the thermal deformation piece is adjusted such that the opening area is decreased by closing at least a part of the outer edge vent in a large curvature (small curvature radius) condition in the above-described low temperature and the opening area of the outer edge vent is increased in a small curvature (large curvature radius) condition in a high temperature.

Although five embodiments are described above, the fuser of the present invention is not limited to the above embodiments. In the above embodiments, the fuser having two rollers of a heating cylindrical body (roller) and a pressure cylindrical body (roller) is described, but any pressure roller such as a belt or a pad can be used as long as the heating roller has the feature of the present invention.

As the image-forming apparatus including the fuser of the present invention, a full color image-forming apparatus having a tandem system in which four color image-forming units are arranged in parallel is described. The fuser according to the present invention can be applied to any image-forming apparatus including a fuser which fusers by means of heat and pressure, and is not limited to the above embodiments. Accordingly, the fuser of the present invention can be applied to a rotary type image-forming apparatus which forms a full color image by sequentially forming respective color images with four image-forming units, and transferring the images on an intermediate transfer body or a recording material, or a monochrome type image-forming apparatus which forms a single color image.

Although the embodiments of the present invention have been described above, the present invention is not limited thereto. It should be appreciated that variations may be made in the embodiments described by persons skilled in the art without departing from the scope of the present invention.

What is claimed is:

1. A fuser, comprising:

a cylindrical heating rotating body including a heat generator; and a pressure rotating body including a circumferential face which has contact with the heating rotating body to form a nip portion for fusing, wherein a disk-like outside plate, which is exposed outside, is provided in one end or both ends of the heating rotating body in a rotation axis direction, a disk-like inside plate is provided in an inner circumferential face of the heating rotating body on an inside of the outside plate to have an interval relative to the outside plate, a center vent is provided near a center of the outside plate, an outer edge vent is provided in an outer edge or the neighborhood thereof of the outside plate, and a flow path, which connects the center vent and the outer edge vent, is provided between the outside vent and the inside vent, wherein a thermal deformation plate including bimetal, to increase or decrease air flow volume in the flow path by a change in a curvature according to temperature in the rotation of the heating rotating body, is disposed between the outside plate and the inside plate.

2. The fuser according to claim 1, wherein a long plate-like member which constitutes at least a part of the flow path, and in which a curvature is changed in a longitudinal direction is fastened in a position in the longitudinal direction as the thermal deformation plate, and an unfastened portion of the thermal deformation plate is arranged to move backward from the flow path side due to a temperature increase.

3. The fuser according to claim 2, wherein a pair of long division plates constituting the flow path is provided, one end portions of the division plates are arranged near the center vent and the other end portions of the division plates are arranged to face each other via the outer edge vent, and at least one of the division plates is constituted by the thermal deformation plate, and is fastened in the other end portion or the neighborhood thereof.

4. The fuser according to claim 1, wherein a pair of long division plates constituting the flow path is provided, one end portions of the division plates are arranged near the center vent and the other end portions of the division plates are arranged to face each other via the outer edge vent, the division plates are disposed to increase an interval therebetween from the one end portion to the other end portion, and at least one of the division plates is slidable in the longitudinal direction relative to the outside plate and the inside plate, an elastic member is provided which presses the slidably disposed division plates in an inner circumferential direction of the heating rotating body, a long plate-like member in which the curvature is changed in the longitudinal direction is provided as the thermal deformation plate, one end or the neighborhood thereof of the long plate-like member is fastened in the inner circumferential face or the neighborhood thereof of the heating rotating body, and an unfastened end or the neighborhood thereof of the long plate-like member is provided to have contact directly or indirectly with an end portion of the slidably disposed division plate on the inner circumferential face side of the heating rotating body, and the plate-like member is arranged such that the unfastened end comes close to the inner circumferential face side of the heating rotating body according a temperature increase.

5. The fuser according to claim 1, wherein the outer edge vent is an opening provided in the outside plate, a movable division plate constituting at least a part of the flow path is provided, the movable division plate includes opposite sides supported in a contact state or a close state with the outside plate and the inside plate, and an elastic member which directly or indirectly presses the movable division plate in the direction which moves backward from the flow path is provided, the movable division plate is constituted to be displaceable in the inside and outside direction of the flow path in an area where a part of the division plate exposes outside from the outer edge vent, a long plate-like member in which a curvature is increased in the longitudinal direction due to a temperature decrease as the thermal deformation plate has directly or indirectly contact with the movable division plate from the outside of the flow path in both ends of the plate-like member or a center of the plate-like member in the longitudinal direction, and is arranged on the side which does not have contact with the movable division plate in a state which has contact with a surface facing the movable division plate and fastened to the outside plate, and is fitted therebetween.

6. The fuser according to claim 5, wherein a moving direction of the movable division plate is an approximately radial direction of the outside plate and an appropriate vertical direction of the movable division plate, and the surface fastened to the outside plate is the inner circumferential face of the heating rotating body.

7. The fuser according to claim 1, wherein the outer edge vent is an opening provided in the outside plate, a movable division plate constituting at least a part of the flow path is provided, the movable division plate includes opposite sides supported in a contact state or a close state with the outside plate and the inside plate, and an elastic member which directly or indirectly presses the movable division plate in the direction which moves backward from the flow path is provided, the movable division plate is constituted to be displaceable in the inside and outside direction of the flow path in an area where a part of the division plate exposes outside from the outer edge vent, a long plate-like member in which the curvature is changed in the longitudinal direction is provided as the thermal deformation plate, one end or the neighborhood thereof of the plate-like member is fastened relatively to outside plate, an unfastened other end or the neighborhood thereof of the plate-like member is provided in a direct or indirect contact state with the movable division plate from the outside of the flow path, and the plate-like member is disposed such that the unfastened other end presses the movable division plate on the flow path side according to a decrease in a temperature.

8. The fuser according to claim 7, wherein a moving direction of the movable division plate is an approximately radial direction of the outside plate and an approximately vertical direction of the movable division plate, and the other end or the neighborhood thereof of the thermal deformation plate is fastened to the inner circumferential face or the neighborhood thereof of the heating rotating body.

9. The fuser according to claim 1, wherein the outside plate is supported to be movable in a rotation axis direction of the heating rotating body, the outer edge vent is a space between the outside plate and an end of the heating rotating body in projection from an end portion of the heating rotating body of the outside plate, a long plate-like member in which a curvature is increased due to a temperature decrease in the longitudinal direction as the thermal deformation plate is provided between the inside plate and the outside plate in a state in which both ends of the plate-like member have contact with the inside plate and the outside plate, respectively, and an elastic member having both ends connected to the inside plate and the outside plate, to pull the inside plate and the outside plate, is provided along the thermal deformation plate.

10. The fuser according to claim 1, wherein the outside vent is an opening provided in the outside plate, and a plate-like piece is provided as the thermal deformation plate, one side which does not curve due to a temperature change is fastened to an end of the outer edge vent, and the plate-like piece is disposed in a position which can close at least a part of the outer edge vent at a low temperature.

11. An image-forming apparatus including the fuser according to claim 1.

* * * * *